US010750833B2

(12) United States Patent
Burchia

(10) Patent No.: US 10,750,833 B2
(45) Date of Patent: Aug. 25, 2020

(54) STACKABLE SUITCASE, ARRANGEMENT COMPRISING TWO SUITCASES STACKED ONE ABOVE THE OTHER AND METHOD FOR STACKING TWO SUITCASES

(71) Applicants: Rothenberger AG, Kelkheim (DE); Plaston AG, Widnau (CH)

(72) Inventor: Rolf Burchia, Widnau (CH)

(73) Assignees: ROTHENBERGER AG, Kelkheim (DE); Plaston AG, Widnau (CH)

( * ) Notice: Subject to any disclaimer, the term of this patent is extended or adjusted under 35 U.S.C. 154(b) by 0 days.

(21) Appl. No.: 15/747,865

(22) PCT Filed: Aug. 18, 2016

(86) PCT No.: PCT/DE2016/100374

§ 371 (c)(1),
(2) Date: Jan. 26, 2018

(87) PCT Pub. No.: WO2017/028845

PCT Pub. Date: Feb. 23, 2017

(65) Prior Publication Data

US 2018/0220758 A1 Aug. 9, 2018

(30) Foreign Application Priority Data

Aug. 18, 2015 (DE) ..... 20 2015 005 752 U

(51) Int. Cl.
*A45C 5/03* (2006.01)
*B25H 3/02* (2006.01)
*B65D 21/02* (2006.01)

(52) U.S. Cl.
CPC ..... *A45C 5/03* (2013.01); *B25H 3/02* (2013.01); *B25H 3/027* (2013.01); *B65D 21/0223* (2013.01); *A45C 2005/037* (2013.01)

(58) Field of Classification Search
CPC .. A45C 5/01; A45C 3/02; A45C 3/027; A45C 21/0223; A45C 2005/037
See application file for complete search history.

(56) References Cited

U.S. PATENT DOCUMENTS 1,084,360 A * 1/1914 Rahm ..... A45C 7/0045 190/108
3,410,376 A * 11/1968 Benzel ..... A45C 7/0022 190/110

(Continued)

FOREIGN PATENT DOCUMENTS

AU 2014202834 B1 7/2015
DE 7244356 U 5/1974

(Continued)

OTHER PUBLICATIONS

International Search Report of PCT/DE2016/100374, dated Nov. 29, 2016.

*Primary Examiner* — Tri M Mai
(74) *Attorney, Agent, or Firm* — Smartpat PLC

(57) ABSTRACT

A suitcase for stacking with a further suitcase, comprising a contact surface for stacking the further suitcase, at least one coupling part which can be brought together with a matching coupling part of the further suitcase to form a plug-in connection, wherein the coupling part is aligned such that the plug-in connection to the matching coupling part is formed by displacing the further suitcase along the contact surface. At least one locking element is provided to secure the plug-in connection against being released, wherein the locking element can be displaced from an initial position to an intermediate or end position, and in the initial position is in a receiving region for the additional suitcase, which is used when placing the further suitcase on the contact surface. The invention further relates to an arrangement comprising at least two suitcases stacked one above the other and a method for stacking at least two suitcases.

16 Claims, 7 Drawing Sheets

(56) References Cited

U.S. PATENT DOCUMENTS

Figure 1:
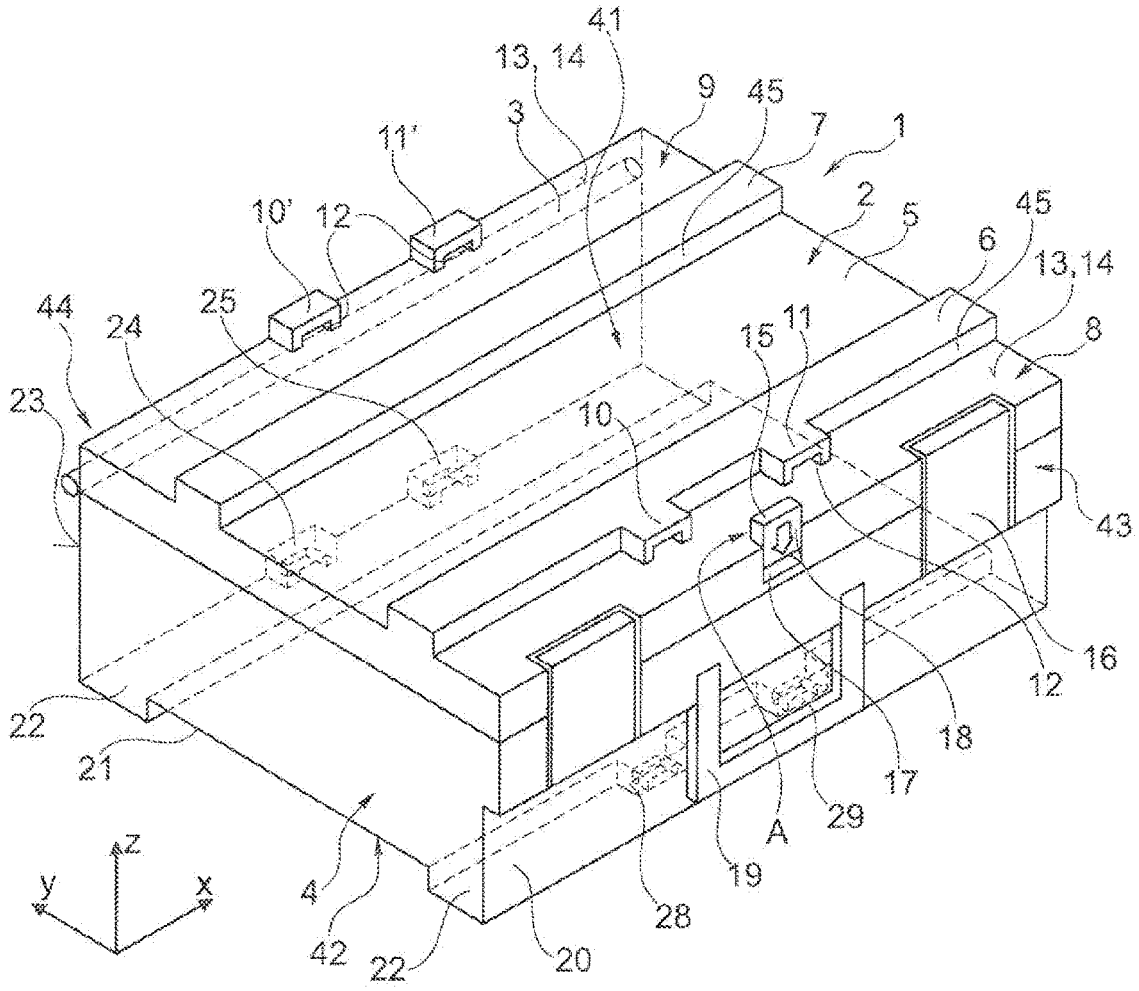

| | | | | |
|---|---|---|---|---|
| 3,757,911 | A * | 9/1973 | Potter | A45C 13/26 190/115 |
| 3,891,230 | A * | 6/1975 | Mayer | B62B 1/14 280/43.24 |
| 4,643,494 | A | 2/1987 | Marleau | |
| 5,544,751 | A | 8/1996 | Klodt et al. | |
| 5,971,119 | A * | 10/1999 | Chi | A45C 7/0045 190/102 |
| 6,098,819 | A | 8/2000 | Link | |
| 6,213,266 | B1 * | 4/2001 | Hollingsworth | A45C 5/14 150/111 |
| 6,367,631 | B1 | 4/2002 | Steigerwald | |
| 6,585,090 | B2 * | 7/2003 | Harvey | A45C 5/04 190/108 |
| 8,561,769 | B2 * | 10/2013 | Andochick | A45C 5/14 190/18 A |
| 8,590,704 | B2 * | 11/2013 | Koenig | A45C 7/0045 206/508 |
| 8,602,217 | B2 * | 12/2013 | Sosnovsky | B25H 3/021 206/503 |
| 2008/0121547 | A1 | 5/2008 | Dur et al. | |
| 2010/0224528 | A1 | 9/2010 | Madsen | |
| 2011/0139665 | A1 | 6/2011 | Madsen | |
| 2011/0155613 | A1 | 6/2011 | Koenig et al. | |
| 2014/0062281 | A1 | 3/2014 | Stegherr | |
| 2015/0069962 | A1 | 3/2015 | Dietzel et al. | |
| 2015/0274362 | A1 | 10/2015 | Christopher et al. | |
| 2017/0318927 | A1 * | 11/2017 | Kraus | A45C 3/00 |

FOREIGN PATENT DOCUMENTS

| | | | |
|---|---|---|---|
| DE | 4003567 | A1 | 8/1991 |
| DE | 4201264 | A1 | 7/1993 |
| DE | 19900361 | A1 | 7/2000 |
| DE | 201 12 393 | U1 | 10/2001 |
| DE | 10015125 | C2 | 2/2003 |
| DE | 10140931 | A1 | 2/2003 |
| DE | 102008064069 | A1 | 5/2009 |
| DE | 20 2012 002 819 | U1 | 5/2012 |
| DE | 10 2011 086 800 | A1 | 5/2013 |
| DE | 10 2013 202 869 | A1 | 9/2013 |
| DE | 102013202869 | A1 | 9/2013 |
| EP | 1 018 473 | A1 | 7/2000 |
| EP | 1516703 | A1 | 3/2005 |
| EP | 2189381 | A1 | 5/2010 |
| EP | 2 346 741 | A1 | 7/2011 |
| EP | 2402259 | A1 | 1/2012 |
| EP | 2703310 | A1 | 3/2014 |
| WO | 2006086900 | A1 | 8/2006 |
| WO | 2007121745 | A1 | 11/2007 |

* cited by examiner

STACKABLE SUITCASE, ARRANGEMENT COMPRISING TWO SUITCASES STACKED ONE ABOVE THE OTHER AND METHOD FOR STACKING TWO SUITCASES

CROSS REFERENCE TO RELATED APPLICATIONS

This application is the National Stage of PCT/DE2016/100374 filed on Aug. 18, 2016, which claims priority under 35 U.S.C. § 119 of German Application No. 20 2015 005 752.7 filed on Aug. 18, 2015, the disclosures of which are incorporated by reference. The international application under PCT article 21(2) was not published in English.

The invention relates to a suitcase for stacking with a further suitcase. The invention further relates to an arrangement comprising at least two suitcases stacked one on top of the other. Furthermore, the invention relates to a method for stacking at least two suitcases.

Suitcases usually serve for transport and/or storage of objects, such as tools, for example. Frequently, the suitcases are configured to be stackable, so that multiple suitcases can be stacked one on top of the other, for example. Such suitcases generally have fastening means for holding a stacked-on suitcase in place.

One embodiment of the invention is based on the task of proposing at least one possibility for allowing stacking of a suitcase on top of another suitcase and reciprocal fastening of the suitcases in the stacked state to be easier to operate and handle.

This task is accomplished with a suitcase as claimed. Furthermore, to accomplish the task, an arrangement comprising at least two suitcases that are stacked one on top of the other is proposed. Furthermore, to accomplish the task, a method for stacking at least two suitcases is proposed.

Advantageous embodiments of the invention are evident from the dependent claims, the following description, and the figures.

According to one embodiment of the invention, a suitcase for stacking with a further suitcase is provided. The suitcase has a contact surface for stacking the further suitcase, and at least one coupling part, which can be brought together with a counter-coupling part of the further suitcase, forming a plug-in connection. The coupling part is aligned in such a manner that the plug-in connection with the counter-coupling part is formed by means of displacement of the further suitcase along the contact surface.

Furthermore, the suitcase has at least one locking element for securing the plug-in connection to prevent release, in particular random release. In particular, the locking element is mounted on the suitcase in movable manner, particularly fastened onto the suitcase or formed on it, for example molded onto it. It is provided that the locking element can be moved from an initial position into an intermediate or end position, in particular compulsorily moved, and in the initial position, is situated in a receiving region for the further suitcase, wherein the receiving region is used during or for setting of the further suitcase onto the contact surface.

In such a suitcase, stacking of the further suitcase can take place so that it is easy to operate and handle, and fastening of the stacked-on further suitcase can be implemented so that it is easy to operate and handle. This is because a coupling connection of the suitcase with the further suitcase can be achieved by means of the coupling part that is provided for forming a plug-in connection, by simple insertion or pinning of the coupling part into or onto the counter-coupling part of the further suitcase. Formation of the plug-in connection is facilitated by the special configuration of the coupling part, and this supports its ease of operation and handling. This is because it is permitted, in particular exclusively permitted, for the plug-in connection of the coupling part with the counter-coupling part to be achieved by means of a targeted movement, in particular a guided movement, namely by means of displacement of the further suitcase along the contact surface. The coupling part can be a plug-in holder. In this regard, the counter-coupling part can be a plug-in element that preferably corresponds to the plug-in holder, which can be inserted into the plug-in holder. Also, vice versa, the coupling part can be a plug-in element and the counter-coupling part can form the plug-in holder for the plug-in element.

By means of the locking element provided, it is possible to effectively secure the plug-in connection of the coupling part with the counter-coupling part of the further suitcase to prevent them from coming apart, in particularly from being pulled apart counter to the interlocking direction. In that the locking element is present in the initial position in the receiving region for the further suitcase, the result is achieved that the further suitcase comes into contact with the locking element, and activates the locking element and thereby brings about a movement of the locking element when the further suitcase performs a set-down movement in the direction toward the contact surface, and gets into the receiving region during this process. As a result, the set-down movement performed by the further suitcase is also used for activation of the locking element. Separate manual activation by an operator is not required. This measure, too, is therefore aimed at supporting ease of operation and handling.

In technically simple manner, contacting of the locking element with the further suitcase can be achieved during the course of its set-down movement, if the locking element projects beyond a bottom surface of the receiving region in the initial position and/or if the locking element extends beyond the bottom surface in the initial position and/or if the locking element is present elevated relative to a bottom surface of the receiving region in the initial position.

For example, it is provided that in the initial position, the locking element projects beyond a bottom surface of the receiving region with one end, and in the intermediate or end position, the one end of the locking element is set back downward as compared with the initial position. In the intermediate or end position, the locking element is then brought outside of the receiving region, for example, and thereby setting the further suitcase onto the contact surface and/or displacing the set-down further suitcase to form the plug-in connection is made possible.

It can be provided that the bottom surface of the receiving region forms at least a part of the contact surface. As a result, the receiving region serves as a region in which the further suitcase is set down.

According to one embodiment of the invention, it is provided that the locking element can be moved in spring-loaded manner. As a result, the energy from a movement of the locking element can be stored in technically simple manner.

For example, it is provided that the locking element can be moved from the initial position into the intermediate or end position counter to a spring force. As a result, the locking element is automatically moved back from the intermediate or end position in the direction of the initial position and/or into the initial position by means of the spring force. This measure, too, supports the ease of operation and handling.

It can furthermore be provided that the locking element is held in the initial position in spring-loaded manner. As a result, the locking element is held in the initial position under spring pre-tension. As a result, possible undesirable wiggling of the locking element in the initial position is counteracted.

In order to be able to displace the locking element under spring stress, a spring element, for example, or another force storage unit is provided. A pressure spring can be used. Also, elastomer springs, leaf springs, helical springs or springs of a general nature can be used. Likewise, torsion springs or plate springs can be used.

According to one embodiment of the invention, it is provided that the locking element is configured as a locking slider, which can be displaced from the initial position into the intermediate or end position, in particular displaced in translational manner. Such a locking element can be implemented in technically relatively simple manner.

The locking element, which is configured as a locking slider, can have or consist of a holding part or bottom part disposed fixed in place on the housing with reference to the suitcase, and a sliding part mounted movably on that, in particular a sliding bolt. The holding part is disposed on the suitcase, in particular attached to it or configured on it, such as formed onto it or formed out of it, for example.

The locking slider can be implemented in technically simple manner if the holding part and the sliding part are configured to be U-shaped in cross-section, and are nested into one another, in opposite directions relative to one another, wherein a pressure spring is disposed between the shanks of the parts, which spring supports itself against a bottom surface of the one holding part, on the one hand, and against a bottom surface of the slider part, on the other hand. In this embodiment of the locking slider, a guided movement of the sliding part relative to the holding part is guaranteed in simple manner by means of the shanks of the holding part and of the sliding part.

It is useful if the slider part is displaceable relative to the holding part with a stop restriction. In this way, it is guaranteed that the displacement movement of the locking slider takes place within predetermined limits and remains within them.

According to a first embodiment of the invention, it is provided that the locking element is configured as a pivot lever, which can be pivoted from the initial position into the intermediate or end position about a pivot axle, in particular a pivot axle fixed in place on the housing. Also, the locking element can be configured as a rotating lever, which can be rotated from the initial position into the intermediate or end position about a rotation axle, in particular a rotation axle fixed in place on the housing. Fundamentally, it is also possible that the locking element has a rotating closure or is formed by a rotating closure, which can be rotated from the initial position into the intermediate or end position relative to a base part, in particular a base part fixed in place on the housing, for rotation.

According to a possible embodiment, the suitcase has a top side, an underside, a front side, and a rear side, wherein the expanse of the suitcase from the front side to the rear side forms a longitudinal expanse. In particular, the top side and the underside lie opposite one another, and form flat sides or surface sides, for example. In particular, the front side and the rear side lie opposite one another and form narrow sides, for example. In particular, the top side and the underside are disposed to lie transversely relative to the front side and the rear side, in particular disposed to lie at a right angle relative to one another.

According to one embodiment of the invention, it is provided that the contact surface is assigned to the top side and that a carrying handle is disposed on the front side of the suitcase, so that when the suitcase is carried by the carrying handle, the rear side faces downward. The suitcase is thereby set upright when the suitcase is held by the carrying handle. The coupling part of the suitcase and the counter-coupling part of the further suitcase must then be engaged into one another to form the plug-in connection, since the contact surface is present as a side surface that lies laterally. In this regard, the plug-in connection forms an engagement connection.

For example, it is provided that the engagement connection is formed by an engagement projection having an engagement opening and an engagement tab, for example in the form of a lobe, which can be brought into engagement with the engagement opening. The coupling part can form the engagement projection and the counter-coupling part can form the engagement tab. Also, the coupling part can form the engagement tab and the counter-coupling part can form the engagement projection.

The engagement tab can be beveled. Also, the engagement opening or the engagement projection can have at least one introduction bevel, in order to allow an engagement connection between the suitcases or suitcase surfaces that are assigned to one another, which connection is secured to prevent displacement and is relatively free of play.

A possible embodiment of the invention consists in that the suitcase has a lower part and a lid part disposed on the former so as to pivot, wherein the top side of the suitcase is formed by the underside of the lid part, and the underside of the suitcase is formed by the underside of the lower part, and the carrying handle is disposed on the lower part. The locking element is then assigned to the lid part, for example.

A further embodiment of the invention consists in that the coupling part is directed in the direction toward the carrying handle, so that the plug-in connection with the counter-coupling part of the further suitcase is formed by means of displacement of the further suitcase away from the front side, in the direction toward the rear side of the suitcase. In this way, the plug-in connection supports coupling of the suitcase with the further suitcase when the suitcase is carried by the carrying handle, since the weight force of the further suitcase acts on the coupling part of the suitcase in the plug-in direction. This is because the weight force acts in the plug-in direction, which is directed in the direction away from the carrying handle, toward the rear side of the suitcase.

According to a further embodiment of the invention, it is provided that the receiving region for the further suitcase is assigned to the top side, and the locking element is disposed in the region of the front side and projects beyond the top side in the initial position.

It is useful if the top side of the suitcase has at least one cross-rib, which runs transversely relative to the longitudinal expanse of the suitcase and has a side surface that projects outward and faces the front side. The side surface can be used as a stop for the further suitcase, for example when the suitcase is held by its carrying handle and thereby the top side of the suitcase lies set up on the side, because of its upright position. In this case, the further suitcase can then support itself against the side surface of the cross-rib with a counter-surface, so that the plug-in connection between the coupling part and the counter-coupling part is relieved of stress, in terms of force, in this way.

It can be provided that the coupling part is fastened to or formed on the cross-rib. In this way, the stability of the coupling part itself is improved, since forces that act on the coupling part are absorbed by the cross-rib.

It can furthermore be provided that the top side of the suitcase has two cross-ribs that each run transversely relative to the longitudinal expanse of the suitcase and have a side surface that stands outward and faces the front side, wherein the cross-ribs delimit a cross-groove that runs between them. This measure is also aimed at being able to absorb a weight force of the further suitcase that acts on the suitcase, and of relieving stress on the plug-in connection when the suitcase is being carried by the carrying handle. This is because two side surfaces are made available by the two cross-ribs, on which the further suitcase can support itself with a corresponding counter-surface, in each instance.

Also, great stability exists if, for example, the suitcase were to be carried in the opposite direction, in which the carrying handle then faces downward. This is because a projection of the further suitcase can be brought into engagement by means of the cross-groove provided, so that the further suitcase supports itself against the suitcase not only when the carrying handle faces downward but also when the carrying handle faces upward.

It is useful to configure the underside of the suitcase corresponding to its top side, so that the suitcase, with its underside, can be stacked onto another suitcase that has a top side configured corresponding to the suitcase. In particular, the underside of the suitcase is configured corresponding to the underside of the further suitcase. In this way, stacking of any desired number of suitcases can be implemented in simple manner, since for this purpose, the suitcases are configured as the same parts and thereby stacking of the suitcases toward the bottom and toward the top can take place, proceeding from a reference suitcase, for example.

For reasons of stability, two coupling parts are provided according to a further embodiment of the invention, which parts can each be brought together with a related counter-coupling part of the further suitcase, forming a plug-in connection, and are oriented in such a manner that the plug-in connection with the counter-coupling part is formed by means of displacement of the further suitcase along the contact surface, wherein the coupling parts are disposed to lie next to one another with reference to the insertion direction or plug-in direction, for production of the plug-in connection.

The measure according to which, according to a further embodiment of the invention, at least one further coupling part is provided, which can be brought into a plug-in connection with a related counter-coupling part of the further suitcases, forming a plug-in connection, and is oriented in such a manner that the plug-in connection with the counter-coupling is formed by means of displacement of the further suitcase along the contact surface, aims in the same direction, wherein the further coupling part and the coupling part are configured to lie one behind the other with reference to the insertion direction, for production of the plug-in connection.

For example, the coupling part is disposed in the region of the edge of the top side that faces the front side. For example, the further coupling part is disposed in the region of the edge of the top side that faces the rear side. Also, the coupling part and/or the further coupling part can be disposed in a central region of the top side of the suitcase.

The one locking element can be provided exclusively. Also, the locking element can be produced multiple times. In this case, the locking elements can be disposed to lie one behind the other transversely to the longitudinal direction of the suitcase.

The at least one locking element can be integrated into the suitcase itself, for example end or be flush with the outer surfaces of the suitcase, or lie or end behind them. Also, it can be provided that the at least one locking element is present as a separate part and, in particular, is connected with the related suitcase surfaces in one or multiple pieces, in terms of material. Furthermore, the locking element, as a separate part or module, can be connected with an outer wall of the suitcase. In this way, subsequent retrofitting of a suitcase with the locking element is facilitated.

According to a further embodiment of the invention, an arrangement comprising at least two suitcases stacked one on top of the other, of which at least one of the suitcases has a contact surface and at least one coupling part, wherein the other suitcase is set onto the contact surface and the coupling part forms a plug-in connection with a counter-coupling part of the other suitcase, which connection is formed by means of displacement of the other suitcase along and/or on the contact surface. Furthermore, at least one locking element is provided, which is present in a locking position that secures the plug-in connection to prevent loosening, in particular random loosening. In the locking position, the locking element is situated in a receiving region for the other suitcase, which region is used when the other suitcase is set onto the contact surface. For example, by means of setting the other suitcase onto the contact surface, the locking element is or was moved from the locking position into a unlocking position with regard to securing of the plug-in connection and/or into a release position, in which pushing the suitcases together to form the plug-in connection between the suitcases is permitted. The locking position can be an initial position, for example the initial position described above.

The at least one suitcase having the contact surface and the at least one coupling part can be the suitcase described above. The suitcase of the arrangement that is stacked on top of it can be the further suitcase described above. For this case, the locking position corresponds to the initial position of the suitcase described above and/or the release position corresponds to the intermediate or end position described above.

For example, on the suitcase that is set on, a surface or a surface section is used or can be used as a stop surface, which is brought or can be brought into contact against the locking element in the locking position of the locking element. The stop surface can be provided on a face side, for example the front side of the stacked suitcase, in particular configured there. The stop surface can also be formed by means of a setback surface or a surface provided with an introduction bevel, in order to thereby achieve an additional pre-tension of the locking element towards the plug-in connection or engagement connection between the stacked suitcases.

The locking element can have an essentially rectangular profile, in order to secure the plug-in connection between the coupling part and the counter-coupling part with some play, so that the coupling part and the counter-coupling part still have some movement play relative to one another when the plug-in connection has been formed, for example a play in the plug-in direction of about 1 to 2 mm, for example, is present, without the plug-in connection coming apart, for example being manually uncoupled.

It can furthermore be provided that the locking element itself or the stop surface against which the locking element lies in the locking position or which can be used as a stop is configured in wedge shape, so that the locking element additionally pre-tenses the plug-in connection in the plug-in direction or insertion direction, and secures the movement of the two stacked suitcases in the plug-in direction, relative to one another.

The invention also comprises a method for stacking at least two suitcases. At least one of the suitcases can be the suitcase described above. Also, the two suitcases, in particular all the suitcases can be formed by the suitcase described above.

In the method, it is provided that one of the suitcases is set onto a contact surface of the other suitcase and subsequently, the suitcase is pushed along the contact surface, over a displacement path, into a plug-in connection with the other suitcase, wherein a locking element is activated by means of setting the suitcase onto the other suitcase, in that the suitcase moves the locking element from an initial position into an intermediate or end position. In the initial position, the locking element is situated in a blocking setting or blocking position, in which the locking element engages into the displacement path for the further suitcase. In the intermediate or end position, the locking element is situated in a release setting or release position, in which the locking element opens up the displacement path.

In this way, the result is achieved that the suitcase comes into contact with the locking element and activates the locking element, and thereby brings about a movement of the locking element when the suitcase performs a set-down movement in the direction toward the contact surface and gets into the receiving region when doing so. Thereby the set-down movement performed by the suitcase is also used for activation of the locking element. Separate manual activation by an operator is eliminated. As a result, advantages occur with regard to operation and handling.

Furthermore, the invention comprises use of the suitcase described above for transport and/or for storage of tools and/or craftsmen's material.

Within the course of the invention, the term "suitcase" should be understood within broad limits. In particular, the suitcase is a container. The suitcase can be a container, for example, that is closed on all sides and provided with a lid. The lid can be disposed on the container so as to pivot. Also, the container and the lid can be present without such a connection. The suitcase that can be set onto the suitcase can be configured in the same manner. Also, it is possible that the suitcase that can be set on is configured as a half-open shell or as a plate, in particular as an adapter plate.

The suitcase is particularly suitable for transporting and/or storing objects. For example, the suitcase is a tool case that serves or can be used for storage and/or for transport of tools, material and/or equipment.

By means of the invention, it is possible that two suitcases that are stacked one on top of the other are brought into a coupling connection, for example a plug-in connection or an engagement connection, wherein the bottom surface of the upper suitcase is set onto the cover surface of the lower suitcase, and a displacement of the two suitcases in an engagement connection or coupling between the two suitcases is produced. By means of the invention, securing of the plug-in connection or coupling connection can take place by means of at least one locking element, such as, for example, a spring-loaded locking slider, which is disposed on the lower suitcase, for example, and which can be activated by the bottom surface of the upper suitcase. By means of the invention, it can furthermore be implemented that after activation has taken place, the locking element comes to lie against a stop surface of the upper suitcase and thereby secures the engagement connection or plug-in connection between the two suitcases to prevent unintentional release.

By means of the invention, the locking element can be disposed in the front region of the lower suitcase, in each instance, and, for example, it can be configured by a locking element that can be pushed out of the top side or cover surface, in such a manner that the locking element lies against a related stop surface on the suitcase that lies on top, in a locking position or in a securing state, and provides security to prevent uncoupling of the one suitcase relative to the other suitcase. To release this secured engagement connection or plug-in connection, the locking element can be activated manually, in order to bring the locking element from the initial position or locking position or securing position into an intermediate or end position and/or unlocking position and/or opening position, and to thereby bring it out of engagement with the related stop surface on the opposite suitcase part.

Further goals, advantages, characteristics, and application possibilities of the present invention are evident from the following description of multiple exemplary embodiments, using the drawing. In this regard, all the characteristics that are described and/or shown in the drawing form the object of the present invention, by themselves or in any desired practical combination, even independent of how they are combined in the claims or what their antecedents are.

THE DRAWING SHOWS

FIG. 1 a possible embodiment of a stackable suitcase in a perspective representation from above, FIG. 2 the suitcase according to FIG. 1 in a perspective representation from below, FIG. 3 a modification of the suitcase according to FIGS. 1 and 2, on which a further suitcase is stacked, in a first assembly state with regard to stacking, shown in a sectional representation of the two suitcases, FIG. 4 the two suitcases according to FIG. 3 in a second assembly state, in which the further suitcase is stacked on the suitcase, FIG. 5 the two suitcases according to FIG. 3 in a third assembly state, in which the further suitcase is stacked on the suitcase and brought into a fastening position against the suitcase, FIG. 6 a schematic representation of the locking principle, as it is evident from FIGS. 3 to 5, FIG. 7 the locking principle according to FIG. 6 in the locked state, FIG. 8 a further possible embodiment of a stackable suitcase having a locking element configured as a pivot lever, in a schematic representation, and FIG. 9 a further possible embodiment of a suitcase onto which a further suitcase is stacked, in a first assembly state with regard to stacking, shown in a sectional representation of the two suitcases.

Figure 2:
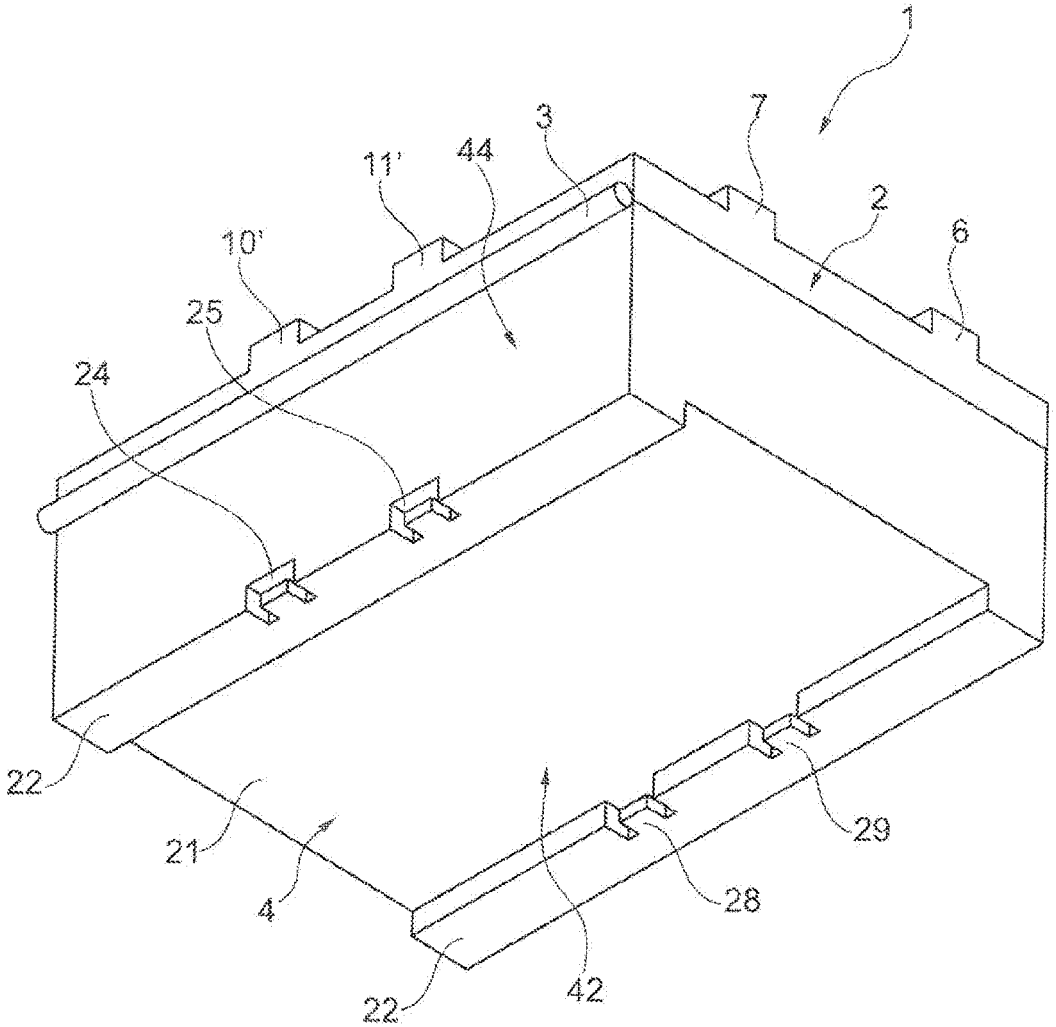

FIGS. 1 and 2—in a schematic representation—show a possible embodiment of a stackable suitcase 1 in a perspective view from above (FIG. 1) and in a perspective view from below (FIG. 2). The suitcase 1 can be used for transporting and/or storing objects. For example, the suitcase 1 is a tool case, which serves for transporting and/or storing tools and/or material and/or equipment of a craftsman or technician, for example.

The suitcase 1 has a top side 41, an underside 42, a front side 43, and a rear side 44. Preferably, the expanse of the suitcase 1 from the front side 43 to the rear side 44 forms a longitudinal expanse, which is also indicated as the Y direction in FIG. 1. Preferably, the expanse of the suitcase 1 from the underside 42 to the top side 41 forms a height expanse, which is indicated as the Z direction in FIG. 1. The expanse of the suitcase 1 transversely to the longitudinal expanse is indicated as the X direction in FIG. 1.

Preferably, the suitcase 1 has a lid part 2 and a lower part 4 that can be covered by the lid part 2. Preferably, the top side 41 of the suitcase 1 is formed by the top side of the lid part 2, and the underside 42 of the suitcase 1 is formed by the underside of the lower part 4. The lid part 2 can be connected with the lower part 2 so as to pivot, for example can be mounted on the lower part 4, so as to pivot, by way of a hinge axle 3, particularly a horizontal axle, which is assigned to the rear side 44, for example. In order to secure the lid part 2 to prevent unintentional opening relative to the lower part 4, closure elements 16, such as closure latches, for example, can be provided. Preferably, the closure elements 16 are assigned to the front side 43.

Preferably, the suitcase 1 has a carrying handle 19. Preferably, the carrying handle 19 is disposed on the front side 43, so that when the suitcase 1 is carried by the carrying handle 19, the rear side 44 faces downward. Preferably, the carrying handle 19 is mounted on the front side 43 so as to pivot. The carrying handle 19 can be assigned to the lower part 4 or to the lid part 2, in particular disposed on it. The suitcase 1 can have a contact surface on the front side 43, against which the carrying handle 19 is laid or can be laid. Preferably, the contact surface is offset toward the rear in the Y direction. Fundamentally, at least one further carrying handle can also be provided, which is assigned to the top side 41, for example.

The suitcase 1 is suitable for stacking with at least one further suitcase. For this purpose, the suitcase 1 has a contact surface 13 for the further suitcase and at least one, preferably at least two coupling parts 10, 11, which can be brought together with a related counter-coupling part of the further suitcase, in each instance, forming a plug-in connection. FIG. 3 shows a further suitcase 1*a*, as an example, which can be stacked onto the suitcase 1. The further suitcase 1*a* has at least two counter-coupling parts 28*a*, 29*a*, which can be brought together with the coupling part 10, 11 of the suitcase 1, forming a plug-in connection. During the course of the further description of the suitcase 1 with regard to the functions provided for stacking of a further suitcase, the suitcase 1*a* of FIG. 3 will already be referred to hereinafter. In the case of the suitcase 1, it is provided that the plug-in connection with the further suitcase 1*a* can only be carried out after the further suitcase 1*a* has been set onto the contact surface 13. For this purpose, the coupling parts 10, 11 are oriented in such a manner that the plug-in connection with the counter-coupling part 28*a* or 29*a*, in each instance, is formed by means of displacement of the further suitcase 1*a* along and/or on the contact surface 13.

Preferably, the coupling parts 10, 11 are oriented in the longitudinal direction or the Y direction in such a manner that the plug-in connection is formed by means of displacement of the further suitcase 1*a* away from the front side 43, in the direction toward the rear side 44 of the suitcase 1. For example, the coupling parts 10, 11 are configured as a plug-in holder, and the counter-coupling elements 28*a*, 29*a* are configured as a plug-in element, which can be inserted into the related plug-in holder through a plug-in opening 12. For example, the plug-in holder forms an engagement lug, and the plug-in element forms an engagement tab, which can be engaged against the engagement lug through the plug-in opening 12 that is configured as an engagement opening. For example, the engagement tab is formed by a lug or tab that projects outward on one side.

Preferably, the plug-in elements or engagement tabs are configured to run in wedge shape in the insertion direction, so that the plug-in elements can be inserted into the related plug-in holders without play, and therefore the plug-in connection is secured to prevent displacement in the X direction and Y direction. Preferably, the plug-in holders or engagement lugs are profiled in wedge shape, corresponding to the plug-in elements. Furthermore, the respective plug-in element and the related plug-in holders are secured, relative to one another, to prevent them from being lifted off in the Z direction.

Preferably, the contact surface 13 is assigned to the top side 41, in particular configured on the top side 41. Preferably, the coupling parts 10, 11 are assigned to the top side 41, in particular configured on the top side 41. Preferably, the suitcase 1 has at least one, preferably two cross-ribs 6, 7 on the top side 41, which ribs run transversely to the longitudinal expanse of the suitcase 1, in each instance, in particular in the X direction, and each have a side surface 45 that projects outward and faces the front side 43.

Preferably, the cross-ribs 6, 7 delimit a cross-groove 5 that runs between them. For example, the lid part 2 has an essentially flat part on its top side, which part has the cross-groove 5 in its center region and is delimited laterally by the cross-ribs 6, 7, which are configured to be elevated. By means of the cross-groove 5, a further suitcase, which is configured to be shorter in the longitudinal direction as compared with the suitcase 1*a*, can be stacked on, wherein then, the further suitcase can engage into or support itself in the cross-groove 5 and/or against the side surface 45 of the cross-rib 7 with its rear end, which faces the rear side 44 of the suitcase 1.

Preferably, the coupling parts 10, 11 are spaced apart from one another in the transverse direction or X direction. Preferably, the coupling parts 10, 11 are each connected with the cross-rib 6 or formed onto the cross-rib 6. Preferably, two further coupling parts 10', 11' are provided, which can each be brought together with a related further counter-coupling part 24*a* or 25*a* of the further suitcase 1*a*, forming a plug-in connection, and are oriented in such a manner that the plug-in connection with the related counter-coupling part 24*a* or 25*a* is formed by means of displacement of the further suitcase 1*a* along and/or on the contact surface 13. Preferably, the further coupling parts 10', 11' and the coupling parts 10, 11 are disposed to lie one behind the other with reference to the insertion direction for production of the plug-in connection, in other words in the Y direction.

Preferably, the coupling parts 10, 11 are disposed to border on a receiving region 8 for the further suitcase 1*a*, in particularly to border on the receiving region 8 in the Y direction. Preferably, the further coupling parts 10', 11' are disposed to border on the further receiving region 9 for the further suitcase 1*a*, in particular to border on the further receiving region 9 in the Y direction. Preferably, the receiving region 8 is disposed on the top side 41 in the front region, which is situated in the edge region toward the front side 43, for example. Preferably, the further receiving region 9 is disposed on the top side 41 in the rear region, which is situated in the edge region toward the rear side 44, for example.

Preferably, the further suitcase 1*a* has a corresponding foot strip 22*a*, in each instance, which extends in the transverse direction or X direction, for example, and projects downward, in order to be held in the receiving region 8 and the further receiving region 9. The foot strip 22*a* can project so far downward, in each instance, that the further suitcase 1*a* is set down onto the bottom surface 14 of the receiving regions 8 and 9 by way of the foot strips 22*a*. The bottom surface 14 then forms the contact surface 13. Alternatively, the foot strip 22*a* can project so far downward, in each instance, that the further suitcase 1*a* is set down onto the cross-ribs 6, 7, and the foot strips 22*a* lie at a distance from the bottom surface 14 of the receiving regions 8 and 9 or also are set down on the bottom surface 14 of the receiving regions 8 and 9. In this case, the top side of the cross-ribs 6, 7 forms a contact surface for the further suitcase 1*a*, at least in part.

Preferably, the foot strips 22*a* run transversely relative to the longitudinal expanse of the further suitcase 1*a*, and delimit a setback 21*a* that lies between them and is configured as a groove that runs transversely, for example. The setback 21*a* is provided for holding the cross-ribs 6, 7 of the suitcase 1, for example. Preferably, the foot strips 22*a* end approximately with the rear wall 23*a* and the front side 43*a* of the further suitcase 1*a*. Preferably, the foot strips 22*a* are configured to be continuous. Fundamentally, the foot strips 22*a* can also be present only in pieces, or can be eliminated entirely.

Preferably, the underside 42 of the suitcase 1 is configured in accordance with the underside of the suitcase 1*a*, so that the suitcase 1 itself can be used for being stacked on top of a suitcase. Preferably, for this purpose the underside 42 of the suitcase 1 is structured to correspond to its top side 41. Preferably, for this purpose at least individual components described with reference to the further suitcase 1*a*, namely the counter-coupling parts 28*a*, 29*a*, the further counter-coupling parts 24*a*, 25*a*, the setback 21*a*, and the rear wall 23*a* are provided on the suitcase 1 as counter-coupling parts 28, 29, further counter-coupling parts 24, 25, setback 21, and rear wall 23.

Furthermore, the suitcase 1 has at least one locking element 18 for securing the plug-in connection that can be formed by the coupling parts 10, 11 and the counter-coupling parts 28*a*, 29*a*, to prevent it from coming loose. The locking element 18 can be moved from an initial position A or rest position, which is shown in FIG. 1, into an intermediate or end position, and is situated in the initial position A in the receiving region 8 for the further suitcase 1*a*. As a result, it is possible that the locking element 18 is activated by the further suitcase 1*a* when the further suitcase 1*a* is set onto the contact surface 13. For this purpose, it is preferably provided that the locking element 18 projects beyond the bottom surface 14 of the receiving region 8 in the initial position A, with an end 15. Preferably, in the intermediate or end position, the end 15 is lowered related to the initial position A.

Preferably, the locking element 18 is assigned to the top side 41 and disposed in the region of the front side 43 of the suitcase 1, for example of the lid part 2. For example, the locking element 18 is disposed in a recess 17 on the front side 43.

Preferably, the locking element 18 can be moved in spring-loaded manner. For example, the locking element 18 can be moved from the initial position A into the intermediate or end position counter to a spring force, so that the locking element 18 automatically moves back from the intermediate or end position into the initial position A by means of spring force.

Figure 3:
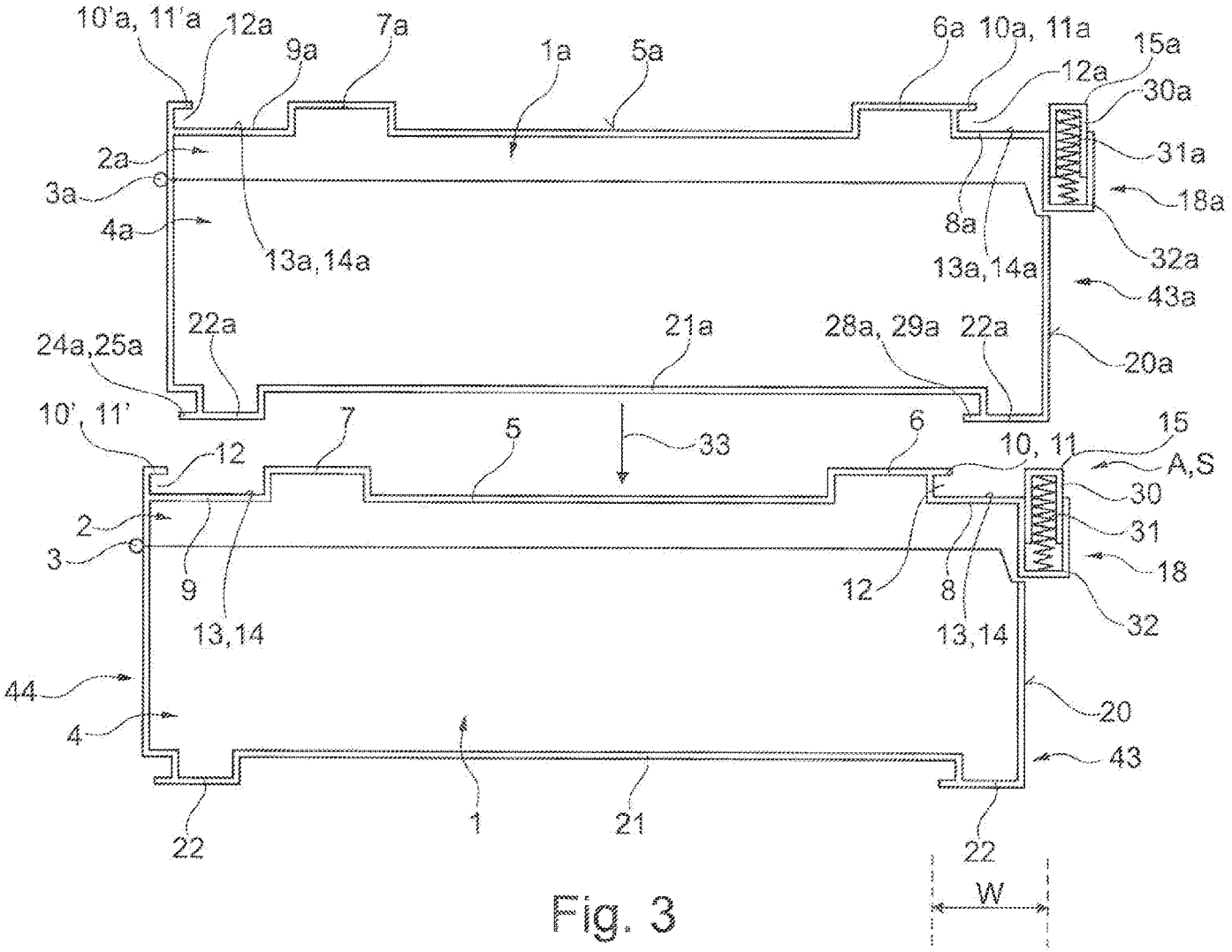

FIG. 3 shows a modification of the suitcase 1 in a sectional representation. As is evident from this, the locking element 18 can be configured as a locking slider, which can be displaced from the initial position A into the intermediate or end position. For this purpose, a holding part 32 or bottom part can be provided, which is assigned to the lid part 2, in particular connected with it or formed from it. The holding part 32 can be profiled in U shape or configured in cup shape, and a pressure spring 31 can be disposed in its recess that opens upward. The pressure spring 31 can support itself on the inside of a sliding part 30, in particular a sliding latch, which is guided on the holding part 32 so as to be displaceable.

Preferably, stops are present, in order to prevent the sliding part 30 from being pushed out of the U-shaped profiled holding part 32 completely by the force of the pressure spring 31. Preferably, the sliding part 30 is configured in U shape or cup shape, and nested into the holding part 32 with its opening coming first, wherein the pressure spring 31 supports itself against the bottom surface of the sliding part 30.

FIG. 3 shows a possible first assembly state with regard to stacking of the further suitcase 1*a* on the suitcase 1. FIG. 4 shows a possible second assembly state, and FIG. 5 shows a possible third assembly state. Components of the further suitcase 1*a* that are identical with or have the same function as components of the suitcase 1 are provided with the same reference symbols and the addition "a". The further suitcase 1*a* can be a suitcase that has the same construction as the suitcase 1.

In the first assembly state according to FIG. 3, the further suitcase 1*a* has been brought into a position, relative to the suitcase 1, so that the further suitcase 1*a* can be set onto the contact surface 13 of the suitcase 1 and the further suitcase 1*a* is held in the receiving regions 8, 9. In order to allow the further suitcase 1*a* to be set onto the suitcase 1, the further suitcase 1*a* is positioned, relative to the suitcase 1, offset in the direction of the Y axis to such an extent that during a set-down movement in the direction of the arrow 33, a collision of the counter-coupling parts 28*a*, 29*a*, 24*a*, 25*a* of the further suitcase 1*a* with the coupling parts 10, 11, 10', 11' of the suitcase 1 is prevented.

The locking element 18 still lies in its initial position A, in which it is situated in the receiving region 8 for the further suitcase 1*a*. In the initial position A, the locking element 18 engages into a displacement path or a displacement segment W, over which the further suitcase 1*a* must be displaced relative to the suitcase 1, in order to arrive at formation of the plug-in connection—in the set-on state. In this regard, the locking element 18 assumes a blocking position S with regard to the displacement path W in the initial position A.

During the course of a set-down movement of the further suitcase 1*a* in the direction of the arrow 33, activation of the locking element 18 by the further suitcase 1*a* takes place, in that the further suitcase 1*a*, for example with the one foot strip 22*a*, presses down on the locking element 18, and the locking element 18 is moved out of the initial position A into the intermediate or end position, counter to the force of the pressure spring 31. In the intermediate or end position, the locking element 18 is situated in a release position F, in which the locking element 18 opens up the displacement path W, so that displacement of the further suitcase 1*a* relative to the suitcase 1, to form the plug-in connection, is permitted. In the second assembly state according to FIG. 4, the locking element 18 has been brought into the release position F by the further suitcase 1*a*.

In the locking position V, the locking element 18 therefore serves as a stop for the further suitcase 1*a*. On the further suitcase 1*a*, the region of the front side 43*a*, for example, which can be offset toward the rear in the Y direction, for example, serves as a corresponding stop surface 20*a*. The carrying handle 19, as described in FIG. 1, can lie against this stop surface 20*a* or be guided on it.

During the course of the displacement movement of the further suitcase 1*a* relative to the suitcase 1 for forming the plug-in connection, the locking element 18 comes to lie against the stop surface 20*a*, for example. In the locking position V according to FIG. 5, the sliding part 30 therefore comes to lie against the front side 43*a* of the suitcase 1*a* and secures the coupling connection between the suitcases 1 and 1*a* to prevent unintentional disengagement.

Figure 4:
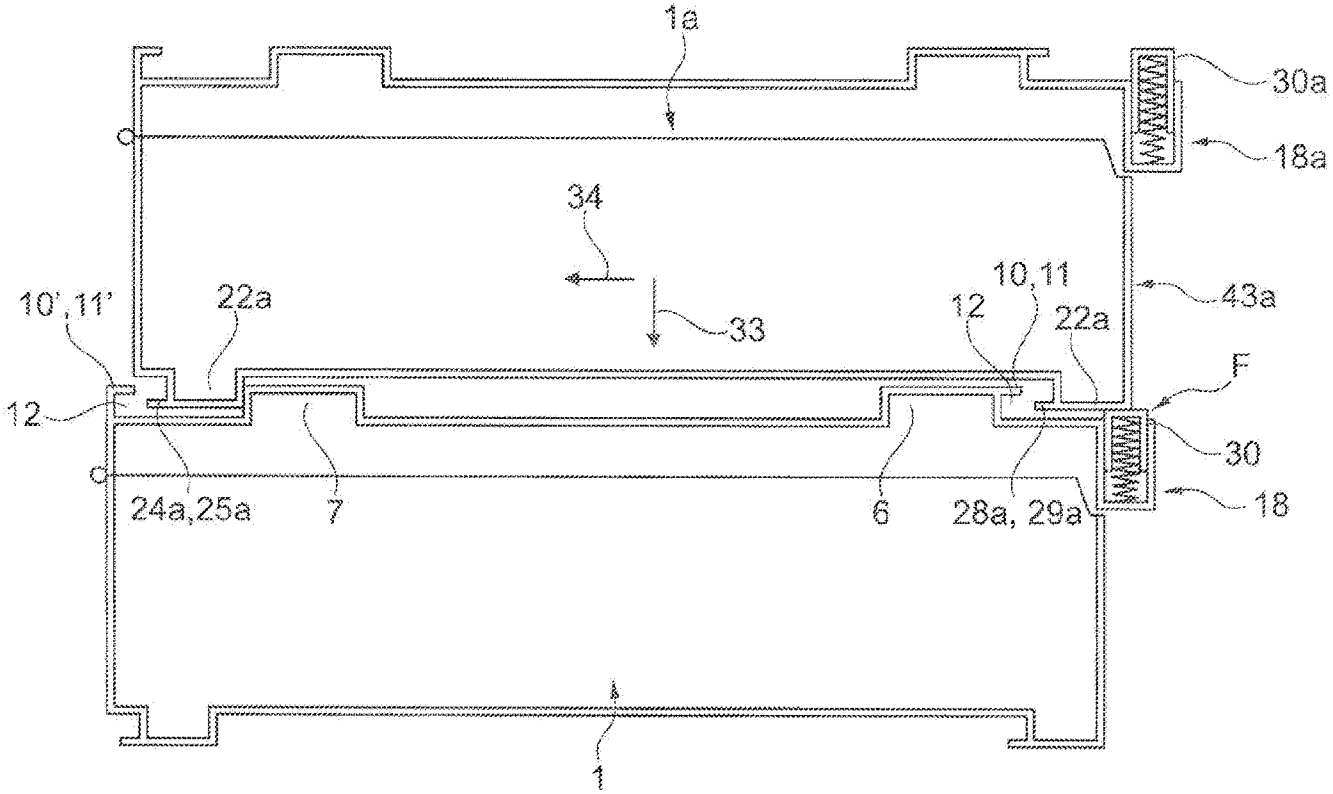
Figure 5:
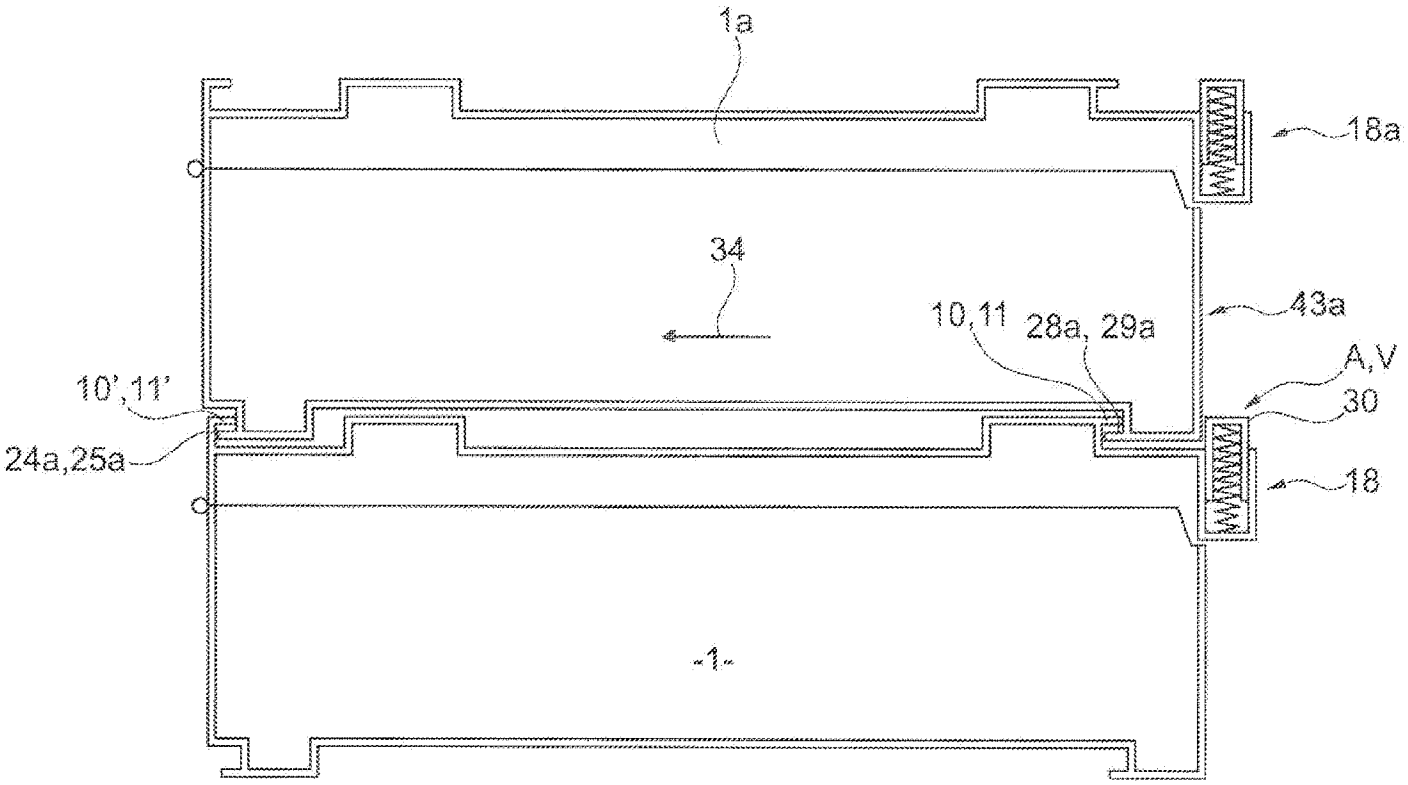

In order to bring this coupling connection or plug-in connection out of engagement again, it is necessary, for example, to manually press the sliding part 30 downward, in order to bring the locking element 18 into the release position F according to FIG. 4. Then, the further suitcase 1*a* can be displaced relative to the suitcase 1, counter to the direction of the arrow 34, and thereby the existing engagement connection or plug-in connection can be opened.

Figure 6:
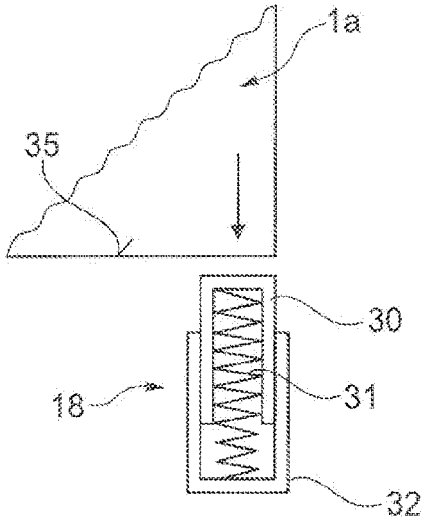
Figure 7:
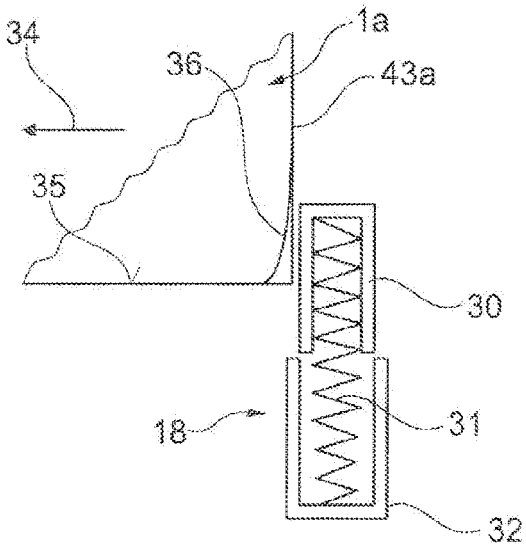

FIGS. 6 and 7 show an enlarged representation of the locking slider 18 of the suitcase 1 together with a detail of the further suitcase 1*a*. As is evident from FIG. 7, pre-tension of the plug-in connection or engagement connection can take place in that either the sliding part 30 and/or the front side 43*a* has/have related wedge surfaces 36 in the region where the sliding part 30 makes contact, in order to thereby additionally pre-tense the engagement connection or plug-in connection in the direction of the arrow 34. Pre-tension takes place with a spring load by means of the pressure spring 31. A bottom-side stop surface or activation surface 35 of the further suitcase 1*a* can always be used as an activation surface for the locking element 18. However, the activation surface 35 is not necessarily a bottom surface. The activation surface 35 can be configured as an offset stop surface or the like, or as a foot strip or the like.

Figure 8:
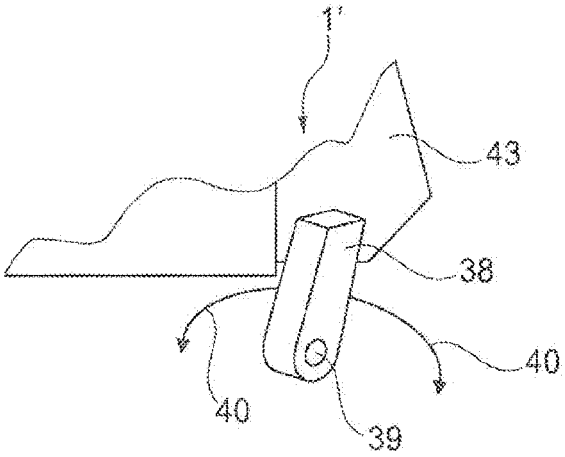

FIG. 8 shows a further embodiment of the suitcase 1' and of a locking element 38 in an enlarged representation. The locking element 38 is configured as a pivot lever there, which can be pivoted from the initial position A into the intermediate or end position about a pivot axle 39. The locking element 38 can be pivoted in the directions of the arrow 40 by means of the pivot axle 39. The pressure spring that is required for a spring pre-load is not shown.

Figure 9:
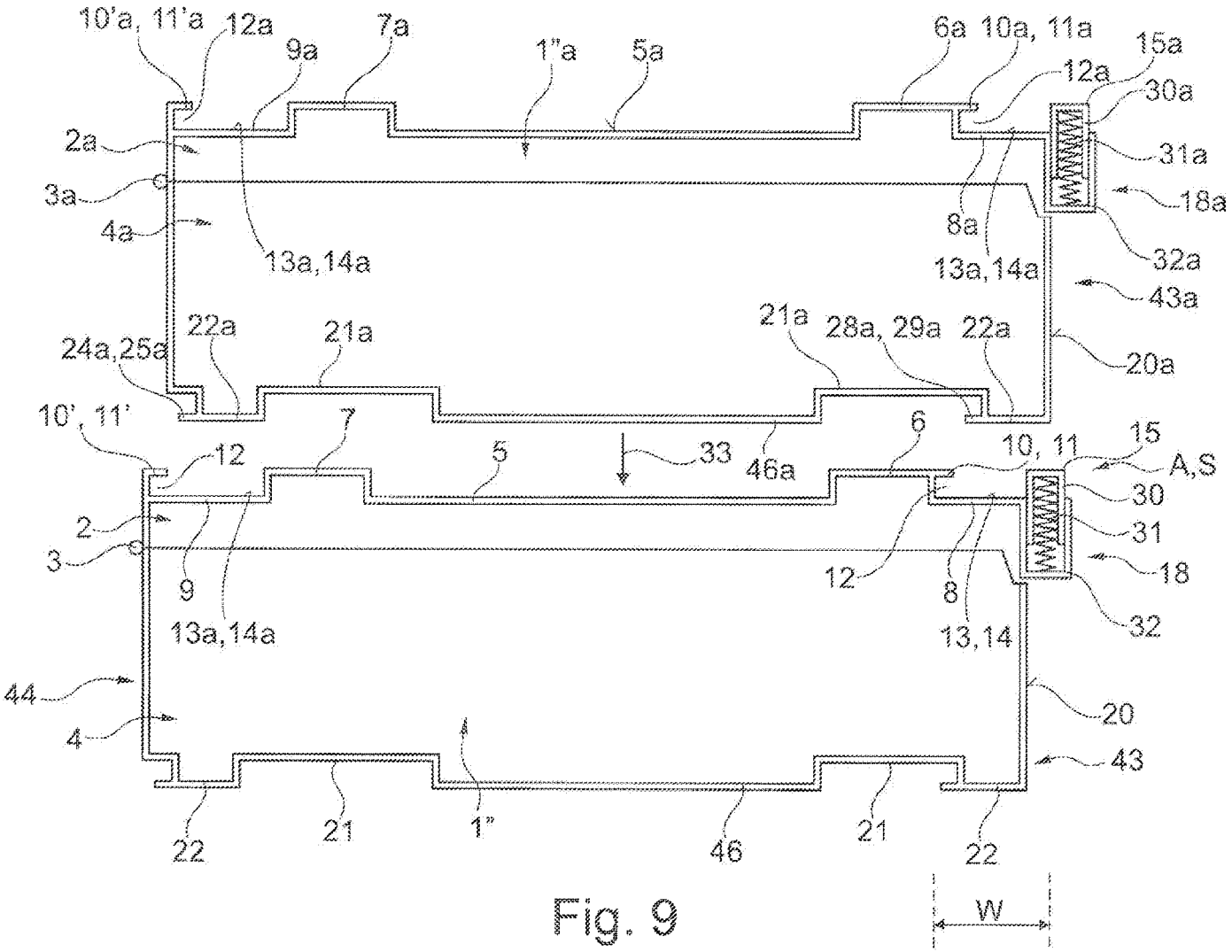

FIG. 9 shows yet another embodiment of a suitcase 1" with a further embodiment of a further suitcase 1*a*". FIG. 9 is based on the representation in FIG. 2. The suitcases 1" and 1*a*" differ from the suitcases 1 and 1*a* in that a projection 46 is provided on the underside 42, which engages into the cross-groove 5 or is provided for engagement.

REFERENCE SYMBOL LIST

1, 1*a* suitcase
1' suitcase
1", 1"*a* suitcase
2, 2*a* lid part
3, 3*a* hinge axle
4, 4*a* lower part
5, 5*a* cross-groove
6, 6*a* cross-rib
7, 7*a* cross-rib
8, 8*a* receiving region
9, 9*a* receiving region
10, 10*a* coupling part
11, 11*a* coupling part
10', 10'*a* further coupling part
11', 11'*a* further coupling part
12, 12*a* plug-in opening
13, 13*a* contact surface
14, 14*a* bottom surface
15, 15*a* end
16 closure element
17 recess
18, 18*a* locking element
19 carrying handle
20, 20*a* stop surface
21, 21*a* setback
22, 22*a* foot strip
23, 23*a* rear wall
24, 24*a* counter-coupling part
25, 25*a* counter-coupling part
28, 28*a* counter-coupling part
29, 29*a* counter-coupling part
30, 30*a* sliding part
31, 31*a* pressure spring
32, 32*a* holding part
33 arrow direction
34 arrow direction
35 activation surface
36 wedge surface
38 locking element
39 pivot axle
40 arrow direction
41 top side
42 underside
43, 43*a* front side
44 rear side
45 side surface
46, 46*a* projection
A initial position
S blocking position
F release position
V locking position
W displacement path

The invention claimed is:

1. A stackable suitcase, comprising:

an underside (42);

a top side (41) arranged at a height above the underside (42);

a front side (43) extending vertically from the underside (42) to the top side (41);

a rear side (44) extending vertically from the underside (42) to the top side (41) at a longitudinal distance from the front side (43);

two foot strips (22) extending transversely across the underside (42) longitudinally spaced from one another;

a setback (21) formed in the underside (42), the setback (21) extending transversely across the underside (42) between the two foot strips (22);

a bottom surface (14) extending transversely across the top side (41) along the front side (43);

two cross-ribs (6, 7) extending transversely across the top side (41) longitudinally spaced from one another;

a cross-groove (5) extending transversely across the top side (41) between the two cross-ribs (6,7);

a first coupling part (10, 10*a*) extending forwardly from a first of the two cross-ribs above the bottom surface (14);

a first counter-coupling part (28, 28*a*) extending rearwardly from a first of the two foot strips above the setback;

and a locking element (18) which is movable parallel to the front side (43) and extends upwardly above the bottom surface, the locking element (18) being arranged forwardly of the first of the two foot strips.

2. The stackable suitcase as in claim 1, wherein the locking element is spring-loaded and can be pushed against a spring force from an initial position, in which the locking element extends upwardly above the bottom surface, to an end position, in which the locking element is arranged below the first coupling part.

3. The stackable suitcase as in claim 1, wherein the first of the two cross-ribs (6) is arranged above the setback (21).

4. The stackable suitcase as in claim 3, wherein a width the first of the two cross-ribs (6) shorted than a width of the setback (21).

5. The stackable suitcase as in claim 1, wherein the first lower coupling part (28, 28*a*) and the first upper coupling part (10, 10*a*) overlap.

6. The stackable suitcase as in claim 1, wherein the underside (42) is arranged at the bottom of a lower part (4) and the top side (41) is arranged at a top of a lid part (2), the lower part (4) and the lid part (2) being connected by a hinge (3).

7. The stackable suitcase as in claim 6, wherein the hinge is arranged at the rear side (44).

8. The stackable suitcase as in claim 1, further comprising a carrying handle (19) arranged on the front side (43).

9. The stackable suitcase as in claim 8, wherein the locking element is arranged directly above the carrying handle.

10. A stackable suitcase, comprising:

a lid part (2) having a top side (41);

a lower part (4) having an underside (42), the lid part (2) and the lower part (4) being connected to one another;

a front side (43) extending from the underside (42) to the top side (41);

a rear side (44) extending from the underside (42) to the top side (41) at a longitudinal distance from the front side (43);

a rear bottom surface (13) arranged on the top side (41) near the rear side (44);

a rear coupling part (10') extending forwardly above the rear bottom surface (13) to form a rear plug-in opening accessible from the front;

a front bottom surface (13) arranged on the top side (41) near the front side (43);

a front coupling part (10) extending forwardly above the front bottom surface (13) to form a front plug-in opening (12) accessible from the front;

a rear foot strip (22) arranged directly below the rear bottom surface (13);

a rear counter-coupling part (24) extending rearwardly from the rear foot strip (22) directly below the rear plug-in opening;

a front foot strip (22) arranged directly below the front bottom surface (13);

a front counter-coupling part (28) extending rearwardly from the front foot strip (22) directly below the front plug-in opening; and a vertically displaceable locking member arranged on the front side (43).

11. The stackable suitcase as in claim 10, further comprising:

a further rear plug-in opening (12) laterally spaced from the rear plug-in opening (12);

a further front plug-in opening (12) laterally spaced from the front plug-in opening (12);

a further rear counter-coupling part (25) extending rearwardly directly below the further rear plug-in opening (12); and a further front counter-coupling part (28) extending rearwardly directly below the further front plug-in opening.

12. The stackable suitcase as in claim 10, further comprising a carrying handle (19) pivotally connected on the front side (43) of the lower part (4).

13. The stackable suitcase as in claim 10, wherein the rear coupling part (10') and the front coupling part (10) are arranged in a common plane and wherein the rear bottom surface (13) and the front bottom surface (13) are arranged in a further common plane.

14. The stackable suitcase as in claim 10, wherein the stackable suitcase is configured to receive a like stackable suitcase by placing an underside of the like stackable suitcase onto the top side of the stackable suitcase and pushing the like stackable suitcase backwards until a rear counter-coupling part of the like stackable suitcase engages the rear plug-in opening and a front counter-coupling part of the like stackable suitcase engages the front plug-in opening.

15. The stackable suitcase as in claim 14, wherein the vertically displaceable locking member prevents forward movement of the like stackable suitcase.

16. The stackable suitcase as in claim 10, wherein the lid part (2) and the lower part (4) are pivotally connected to one another by a hinge (3).

* * * * *